US006463627B1

(12) United States Patent
Hirtsiefer

(10) Patent No.: US 6,463,627 B1
(45) Date of Patent: Oct. 15, 2002

(54) LID STAY WITH A FIRST AND SECOND ARM PIVOTALLY CONNECTED TO THE FIRST ARM

(75) Inventor: Artur Hirtsiefer, Neunkirchen-Seelscheid (DE)

(73) Assignee: Huwil-Werke GmbH Mobelschloss- und Beschlagrabriken (DE)

( * ) Notice: Subject to any disclaimer, the term of this patent is extended or adjusted under 35 U.S.C. 154(b) by 0 days.

(21) Appl. No.: 09/553,268

(22) Filed: Apr. 20, 2000

(30) Foreign Application Priority Data

Apr. 26, 1999 (DE) ..... 199 18 823

(51) Int. Cl.[7] ..... E05F 1/08

(52) U.S. Cl. ..... 16/286; 292/262; 292/DIG. 19

(58) Field of Search ..... 292/262, 263, 292/DIG. 11, DIG. 19, 275; 16/286, 338, 341, 337; 49/386

(56) References Cited

U.S. PATENT DOCUMENTS 566,621 A * 8/1896 Rider ..... 16/186
2,711,556 A * 6/1955 Magnuson ..... 16/337
3,541,632 A * 11/1970 DuShane ..... 16/337
4,483,044 A * 11/1984 Johnston ..... 16/341
4,545,322 A * 10/1985 Yang ..... 49/386
5,904,411 A * 5/1999 Hayakawa ..... 16/289

FOREIGN PATENT DOCUMENTS

DE 2653106 C2 4/1984
EP 0646690 A1 4/1995
SE 99301 * 7/1940 ..... 292/275

* cited by examiner

*Primary Examiner*—Flemming Saether
(74) *Attorney, Agent, or Firm*—Harness, Dickey & Pierce, P.L.C.

(57) ABSTRACT

A lid stay for holding a lid of a piece of furniture has a first arm (1) and a second arm (2) pivotably connected to the first arm (1). The arms (1, 2) are movable between an open position and a closed position around a swivel axis (4). A friction mechanism (9, 10) is active between the first arm (1) and the second arm (2). A spring mechanism acts upon the second arm (2) in the direction towards the open position or in the direction towards the closed position. The spring mechanism influences the frictional force that acts upon the friction means (9, 10).

2 Claims, 1 Drawing Sheet

LID STAY WITH A FIRST AND SECOND ARM PIVOTALLY CONNECTED TO THE FIRST ARM

CROSS-REFERENCE TO RELATED APPLICATIONS

This application claims priority upon German application 199 18 823.8 filed Apr. 26, 1999, which application is incorporated herein by reference.

BACKGROUND OF THE INVENTION

The invention relates to a lid stay to hold open a lid or a flap on a piece of furniture. The lid, as a rule, is vertically arranged and pivotably attached to the piece of furniture. The lid is pivotably attached to the furniture piece by hinges, for example, at the upper edge of the lid. Therefore, the lid can be folded from the vertically closed position upwards into an open position. Accordingly, the lid is essentially arranged horizontally or inclined.

DE 26 53 106 C2 discloses a flap holder for an upwards or downwards opening flap. The flap holder has two arms that are pivotably connected to each other at one end around a swivel axis. The other ends of the arms are provided with connection means to connect the arms to a fitting. One of the fittings serves to fix the arm to a body of the furniture piece, which is closable by the flap and the other fitting serves to fix the arm to the flap. One of the arms has a cam contour in the area of the swivel axis. The cam contour has cam faces extending parallel to the swivel axis. The other arm supports a slider, which is movable in the longitudinal direction of the arm. This slider is preloaded by a spring in a direction towards the swivel axis. The spring is arranged within a square opening of the arm. The slider has a hole which enables the slider to be movably mounted on the arm. The hole encloses the arm and the spring. A front face faces the swivel axis. The front face forms an abutment face for the cam contour and acts as a sliding face. The front face extends transversely to the adjustment direction of the slider. A groove follows the flat sliding face. One of the cam faces collaborates with the abutment face of the slider in an open position of the arms. The arms are supported. In the closed position of the flap, the one cam face collaborates with a face of the groove. Accordingly, the flap is pulled into the closed position. The disadvantage of this embodiment is, that the flap is only held in specific positions when the cam face collaborates with the sliding face. In all the other positions, the flap is not held and falls downwards.

EP 0 646 690 A1 discloses a stay, which is preferentially used in roof boxes for vehicles. The stay holds the lid of the roof box in an open position. The stay has two arms. The arms are pivotably connected to each other around a swivel axis. A spring acts between the two arms. The spring moves the arms to a position where the lid of the roof box is in the open position. Accordingly, the spring supports the lid while opening the lid of the roof box. However, as the spring force changes dependent on the position of the arms, with respect to one another, the lid of the roof box is only held in a position, as long as the torque around the swivel axis caused by the spring force balances the torque caused by the mass force of the lid of the roof box. In positions of the arms which differ from the above, the lid of the roof box closes or is forced in the direction towards the open position.

SUMMARY OF THE INVENTION

An object of the present invention is to provide a lid stay for upwards opening lids, which enables an easy moving of the lid which holds the lid in every desired position over the swivel area of the lid.

Accordingly, the lid stay of the present invention includes a first arm and second arms. The second arm is pivotably connected to the first arm around a swivel axis. The second arm is movable between an open position and a closed position.

A friction member is effective between the first arm and the second arm. A spring urges the second arm in a direction to the open position or in a direction to the closed position. The spring acts upon the friction member to influence the frictional force.

Over the swivel area of the lid the torque around the swivel axis of the lid stay changes continuously due to the mass force of the lid and due to the spring force of the lid stay. Additionally, the friction member forms a torque caused by frictional forces. These frictional forces must additionally be overcome to the torque caused by the mass force while opening the lid. The frictional forces and the torque caused by the spring force have to be overcome while closing the lid. Even in swivel positions of the lid, where the torque caused by the mass force and the torque caused by the spring force are not balanced out, the lid is still held in its position, as a torque caused by the frictional forces must additionally be overcome.

In order to open the lid, not all the total mass force of the lid has to be overcome. Since the spring force supportingly acts on the lid stay, it helps in opening the lid. Only the torque caused by the frictional force and the difference between the torque caused by the spring force and the torque caused by the mass force have to be overcome in order to open the lid. The same is applicable for closing the lid, as the mass force works supportively against the positioning force of the lid stay.

The torque to be overcome and caused by the frictional forces is always adapted to the actual swivel position of the lid. At swivel positions of the lid in the vicinity of the open position, the spring force and the torque resulting from that position is smallest. In the case where the spring force is sufficient to move the lid into the open position, the frictional forces guarantee that the lid is held in its swivel position. In the case where the torque caused by the spring force is smaller than the torque caused by the mass force, the torque to be overcome, caused by the frictional forces, acts in reverse and keeps the lid in the respective swivel position as well preventing the lid from falling downwards. In swivel positions in the vicinity of the open position, the spring force is smallest and results in small frictional forces. These small frictional forces are sufficient for small differences between the torque caused by the spring force and the torque caused by the mass force. If the lid is moved from the open position to the closed position, due to the lever ratios, the spring forces and thus the opening torque of the lid stay increase and the torque caused by the mass force of the lid decreases. As the frictional forces increase proportional to the spring forces, the lid is prevented from opening the positioning force of the lid stay. The frictional forces are therefore always adapted to the respective force ratios and hold the lid in any position.

A compact lid stay design is provided, which is movably supported relative to a first arm and connected to a second arm. An adjustment slider is kept in frictional contact with the first arm. The slider represents the friction member. The springs are represented by compression springs, which act upon the second arm, via the adjustment slider.

Preferably, the first arm includes a housing. The adjustment slider is movably supported in the housing. Likewise, the spring mechanism is arranged in the housing. The adjustment slider is in frictional contact with the inner faces of the housing. Preferably, the spring mechanism is in the form of compression springs. The compression springs are arranged within the adjustment slider. The adjustment slider and the spring mechanism are protected within the housing. Accordingly, the springs and the adjustment slider are not exposed to exterior influences. Thus, this reduces the chance that the spring mechanism or the adjustment slider will be damaged.

The adjustment slider includes a first slider part and a second slider part. The first and second slider parts are respectively in frictional contact with one inner face of the housing. The spring mechanism is supported against the second slider part. The first slider part is connected to the second arm. The first slider part abuts the second slider part, via an adjustment face. The adjustment face abuts an abutment face of the second slider part. The adjustment face and the abutment face are arranged at an angle to the adjustment direction of the adjustment slider. Therefore, the two slider parts are forced apart with increasing spring force. Thus, the outer faces of the slider parts are pressed stronger against the inner faces of the housing.

In a preferred embodiment, the second arm includes a lever. The lever eccentrically connects to the swivel axis. The axis of rotation extends parallel to the swivel axis. The lever is rigidly connected to the adjustment slider in the adjustment direction of the adjustment slider. Also, the lever is movably connected to the adjustment slider transverse to the adjustment direction of the adjustment slider.

From the following detailed description, taken in conjunction with the accompanying drawings and subjoined claims, other objects and advantages of the present invention will become apparent to those skilled in the art.

BRIEF DESCRIPTION OF THE DRAWINGS

A preferred embodiment is further described with reference to the following drawings.

DETAILED DESCRIPTION OF THE PREFERRED EMBODIMENT

Figure 1:
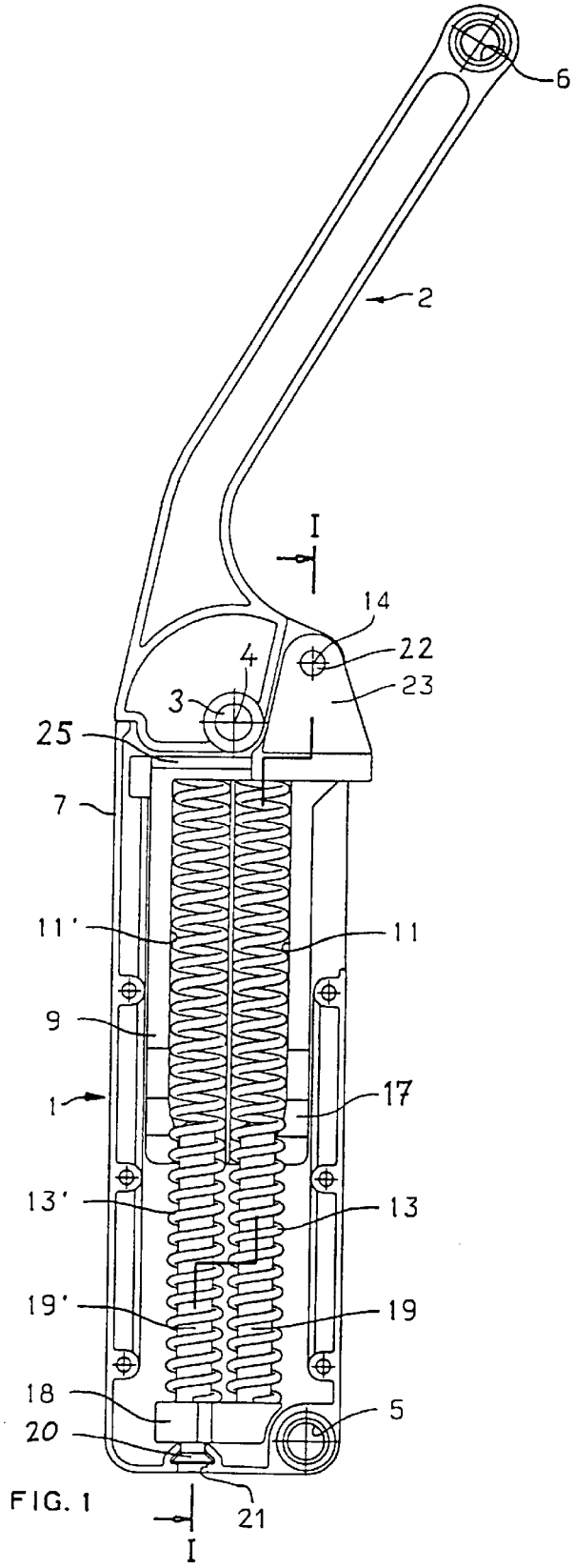
FIG. 1 is a side elevation view partially in section of the lid stay according to the invention.
Figure 2:
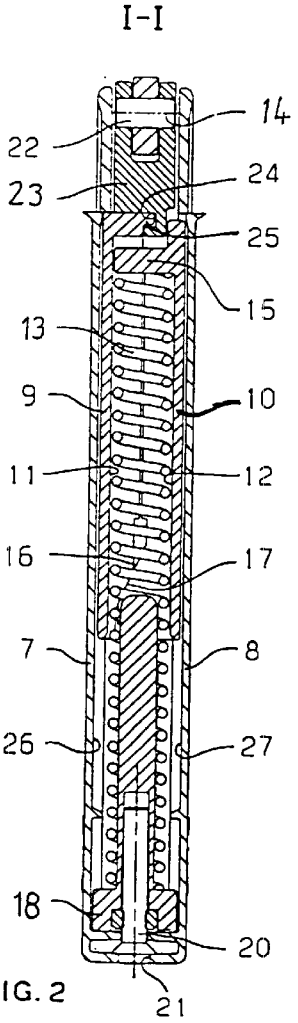
FIG. 2 is a sectional view of the lid stay of FIG. 1 along line I—I thereof.

Turning to FIGS. 1 and 2, the lid stay includes a first arm 1 and a second arm 2. The arms 1 and 2 are swivably connected to each other at one end by a hinge pin 3. The hinge pin 3 defines the swivel axis 4. Connection holes 5 and 6, respectively, are provided at the other ends of both arms 1, 2. The holes 5, 6 serve to pivotably connect to a fitting. The arms 1, 2 are mounted by fittings to a lid or to a body of a piece of furniture.

The first arm 1 has a housing. The housing has a first housing part 7 and a second housing part 8. An adjustment slider, including a first slider part 9 and a second slider part 10, is slidably supported within the housing. Two longitudinal grooves 11, 11' are provided in the first slider part 9. The longitudinal grooves 11, 11', together with the corresponding longitudinal grooves 12 in the second slider part 10, form guides for the coil springs 13, 13'. The springs 13, 13' act upon the adjustment slider in the direction towards the swivel axis 4. The coil springs 13, 13' are arranged within the longitudinal grooves 11, 11', 12. The coil springs 13, 13' are supported at one end of the longitudinal grooves 12 of the second slider part 10 against a wall portion 15. At the opposed end of the longitudinal grooves 12 the second slider part 10 has an adjustment face 16. The adjustment face 16 is inclined to the adjustment direction of the adjustment slider 10. The adjustment face 16 slidingly abuts an abutment face 17 of the first slider part 9.

A spring tightener 18 supports the other ends of the coil springs 13, 13'. The spring tightener 18 has guide bolts 19, 19'. The coil springs 13, 13' are fixed to the guide bolts 19, 19'. The guide bolts 19, 19' guide the coil springs 13, 13' in the housing. The spring tightener 18 abuts inside the housing via a bolt 20. The bolt 20 is screwed into the spring tightener 18. The bolt 20 can be adjusted with a screwdriver through hole 21. Thus, the spring tightener 18 is moved against the spring force of the coil springs 13, 13' to preload the coil springs 13, 13'.

A lever 23 is pivotably connected to the second arm 2 via a hinge pin 22, around the axis of rotation 14. The axis of rotation 14 is arranged parallel to, yet offset to the swivel axis 4. The lever 23 has a groove 24. The groove 24 is arranged transverse to the adjustment direction of the adjustment slider. The adjustment slider comprises two slider parts 9, 10. The groove 24 grips around a correspondingly formed projection 25 of the first slider part 9. Thus, the lever 23 is rigidly connected with the first slider part 9 in the adjustment direction of the adjustment slider 9, 10. The lever 23 is transverse to the adjustment direction of the adjustment slider 9, 10 movably supported on the first slider part 9.

If the second arm 2 is moved from its shown open position in FIG. 1, towards its closed position, where the two connection holes 5, 6 of the arms 1, 2 are moved towards each other, the first slider part 9 is pressed in the direction to the spring tightener 18 by the lever 23. The first slider part 9 is supported via the adjustment face 16 on the abutment face 17 of the second slider part 10. The first slider part 9 also moves the second slider part 12 in the direction to the spring tightener 18. When this occurs, the coil springs 13, 13' are supported on the wall portion 15 of the second slider part 10. Thus, a transverse force, which forces the slider parts 9, 10 against the inner faces 26, 27, is achieved because the faces 16, 17 are inclined to the adjustment direction of the slider parts 9, 10. The transverse force increases the frictional force between the slider parts 9, 10 and the inner faces 26, 27.

While the above detailed description describes the preferred embodiment of the present invention, the invention is susceptible to modification, variation and alteration without deviating from the scope and fair meaning of the subjoined claims.

What is claimed is:

1. A lid stay, comprising:

a first arm, said first arm includes a housing;

a second arm pivotably connected to the first arm around a swivel axis, said first and second arms movable between an open position and a closed position;

friction means effective between the first arm and the second arm, said friction means including an adjustment slider movably supported relative to the first arm and connected to the second arm, said adjustment slider movably supported in said housing and in frictional contact with inner faces of said housing, and said adjustment slider including a first slider part and a second slider part, said first and second slider parts in frictional contact with said inner faces of the housing; and spring means for urging said second arm in direction to the open position or in direction to the closed position and said spring means acting upon the friction means influencing frictional force, said spring means including compression springs acting upon the second arm via the adjustment slider, and said spring means positioned in said housing, and said spring means supported against the second slider part, the first slider part connected to the second arm, the first slider part abutting the second slider part via an adjustment face, said adjustment face abutting an abutment face of the second slider part, and said adjustment face and abutment face being arranged at an angle to the adjustment direction of the adjustment slider.

2. The lid stay according to claim 1, wherein the second arm includes a lever pivotably connected to the second arm around an axis of rotation, said axis of rotation positioned eccentrically with respect to the swivel axis, said axis of rotation extends parallel to the swivel axis, and said lever in the adjustment direction of the adjustment slider is rigidly connected to the adjustment slider part and said lever being movably connected to the adjustment slider transverse to the adjustment direction.

* * * * *